United States Patent [19]

Cantwell

[11] Patent Number: 5,003,769

[45] Date of Patent: Apr. 2, 1991

[54] SELF-CHECKING SPEED GOVERNOR ARRANGEMENT

[75] Inventor: Hugh F. Cantwell, Derby, England

[73] Assignee: Rolls-Royce plc, London, England

[21] Appl. No.: 370,797

[22] Filed: Jun. 23, 1989

[30] Foreign Application Priority Data

Jun. 30, 1988 [GB] United Kingdom ..... 8815623

[51] Int. Cl.[5] ..... F02C 9/28

[52] U.S. Cl. ..... 60/39.281; 415/16

[58] Field of Search ..... 60/39.081, 39.281; 415/16; 73/507, 508, 509, 535

[56] References Cited

U.S. PATENT DOCUMENTS 4,528,812 7/1985 Cantwell ..... 60/39.281

4,712,372 12/1987 Dickey et al. ..... 60/39.281

4,837,697 6/1989 Eisa et al. ..... 60/39.281

*Primary Examiner*—Louis J. Casaregola

*Attorney, Agent, or Firm*—Cushman, Darby & Cushman

[57] ABSTRACT

A simple rotary bobweight overspeed governor mechanism is conveniently incorporated in a main fuel control system for a gas turbine aeroengine in order to prevent overspeeds of one and more of its compressor/turbine rotating spools. In order to prevent so-called "dormant" failures of the overspeed governor mechanism going undetected, the invention provides automatic checking of governor function by means of a microswitch linked to a main digital electronic controller of the fuel control system. The position of a spindle in the governor mechanism is proportional to the speed of the spool from which it is driven and each time the spindle is at the position which should correspond to a predetermined proportion of the maximum allowable spool speed, the microswitch is actuated and signals the electronic controller. The latter already receivers a spool speed signal from a tachometer on the engine and if the microswitch signal oocurs at the predetermined proportion of maximum spool speed as measured by the tachometer, the electronic controller outputs a validation signal, otherwise it outputs a warning signal.

14 Claims, 2 Drawing Sheets

100
AIRCRAFT SOV INPUT
124
SOV
112
FUEL METERING UNIT
108
118
FUEL TO BURNERS
102
FUEL CONTROL SIGNAL
VIGV'S AND BLEED VALVES (1IP+2HP3)
126
VIGV AND BLEED VALVE CONTROL UNIT
120
ENGINE INPUTS
SE
FULL AUTHORITY FUEL CONTROL UNIT
110
111
N3
N2
L
STORE
LED
326
328
A/C DATA BUS
324
323
322
N3 GOVERNOR
114
PUMP UNIT AND VALVES
104
HP FUEL
116
SPILL
320
106
128
LP FUEL
122
AIRCRAFT INPUTS
SA
ENGINE INPUTS (INC. N2 & N3)
SE

SELF-CHECKING SPEED GOVERNOR ARRANGEMENT

FIELD OF THE INVENTION

The present invention relates to fuel control systems for gas turbine aeroengines, and in particular to speed governors for governing the rotational speeds of compressor/turbine spools in such engines.

BACKGROUND OF THE INVENTION

It has been conventional practice to provide gas turbine aeroengines with simple bobweight governors of a hydromechanical type in order to prevent hazardous overspeeds of one or more of the spools of the aeroengine, the arrangement being such that when the rotational speed of the governed spool exceeds a certain predetermined limit, the governor mechanism effects reduction of the fuel supply to the engine and thereby reduces the speed of the spool to an acceptable value. With the recent introduction of digital electronic fuel controllers for gas turbine aeroengines, the latest design practice is tending to implement the function of overspeed limiting electronically by means of digital computers. However, there remains a case for implementing the overspeed limiting function by the traditional hydromechanical governor means for at least the high pressure (and therefore high speed) spool of a multispool gas turbine aeroengine. This is because a simple hydromechanical governor can act as a high-reliability back-up speed limiting device for the whole engine; even if electronic speed limiter(s) fail to control the speed of the lower pressure spool(s) due, e.g. to damage sustained by the electronic components, the fact that the high pressure spool is also speed limited will under most circumstances limit the speed of the other spools(s) too.

A problem inherent in speed governing devices of the above type, which exert control over the engine only when other controls have failed, is that although they are highly reliable, it is nevertheless possible for them to experience a so-called "dormant failure", that is, some sort of breakage or other fault which occurs at a time when the device in question is not participating in control of the engine, the failure only being apparent when the device fails to operate satisfactorily when required. To overcome this problem it is known to schedule regular manual checks or resets of the device and to carry out ground runs of the engine for observation of the device's correct working. Clearly, operators of the engine would prefer not to have to do this and elimination of such activities would result in increased economy of operation.

It is an object of the present invention to provide the operators of gas turbine aeroengines, particular those having digital electronic fuel control systems, with an automatic means of assuring themselves that a mechanical speed governing device installed on the engine has not suffered from a dormant failure.

Accordingly, the present invention provides a self-checking governor arrangement for controlling the rotational speed of a spool in a gas turbine engine, comprising:

a displaceable member and means for effecting its displacement by an amount which varies with said spool speed;

valve means for controlling fuel flow to the engine, the valve means being actuatable by the displaceable member to reduce fuel flow to the engine in dependance upon said displacement of said displaceable member;

switch means actuatable by the displaceable member to output a switch signal whenever said displaceable member is displaced by a predetermined amount corresponding to a predetermined spool speed within a predetermined normal range of spool speeds experienced by said spool during normal operation of said engine;

means for generating a spool speed signal whose value varies with said rotational speed of said spool; and data processing means connected to receive said switch signal and said spool speed signal, said data processing means being adapted to determine whether receipt of the switch signal substantially coincides with receipt of a value of the spool speed signal corresponding to said predetermined spool speed and to output a governor status signal dependent upon the result of said determination.

In this way, the correct operation of the governor mechanism can be automatically checked during run-up of the engine before every takeoff, assuming of course that the above-mentioned predetermined spool speed is suitably chosen.

The above-mentioned means for effecting displacement of the displaceable member by an amount which varies with the engine spool speed conveniently comprises bias means acting against said displacement and a rotary mechanism driven from said spool for displacing the displaceable member against said bias means by an amount directly related to the spool rotational speed.

The invention is particularly useful as an overspeed governor and in this case the valve means is arranged such that it is actuated by the displaceable member to reduce fuel flow only when displacement of the displaceable member attains a large predetermined amount indicative of a spool speed beyond said predetermined normal range of spool speeds.

The switch means comprises a switching device of some sort, such as a microswitch, and any associated circuitry necessary to produce a signal suitable for use as the switch signal for input to the data processing means.

The data processing means may be adapted to output a signal indicative of satisfactory operation of the governor arrangement whenever said receipt of said switch signal occurs substantially simultaneously with said receipt of said value of said spool speed signal. Alternatively, the data processing means may be adapted to output a signal indicative of unsatisfactory operation of the governor arrangement whenever receipt of said switch signal does not occur substantially simultaneously with said receipt of said value of said spool speed signal.

It is convenient if the self-checking governor arrangement is part of a main fuel control system of the engine, the data processing for checking of the governor function being performed in a digital electronic controller forming part of the main fuel control system.

It is preferred that the displaceable member be part of a bobweight governor mechanism.

Most current gas turbine aeroengines are of the two or three spool type and usually the invention will be applied to a governor controlling the high pressure spool of the engine.

BRIEF DESCRIPTION OF THE DRAWINGS

Embodiments of the invention will now be described, by way of example only, with reference to the accompanying drawings, in which.

DETAILED DESCRIPTION OF THE PREFERRED EMBODIMENTS

Figure 1:
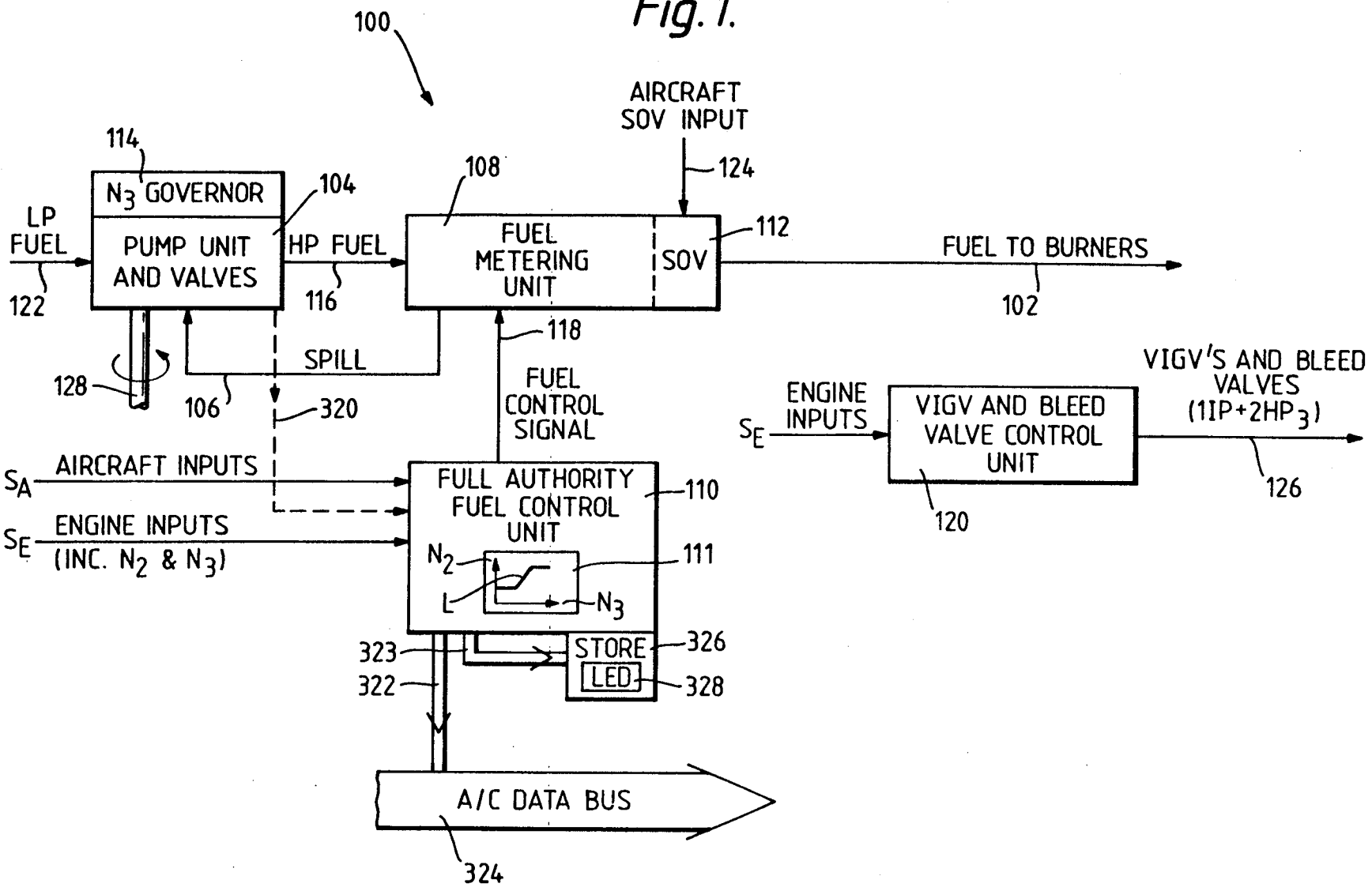
FIG. 1 is a block diagram illustrating in simplified form a fuel control system for a triple spool gas turbine aeroengine, the control system being in accordance with the present invention.

Referring first to FIG. 1, a control system 100 controls the fuel flow 102 to a three spool gas turbine aeroengine (not shown), comprising low, intermediate and high pressure spools, as known. Apart from the inventions disclosed herein and in our prior patent application GB8730187, the control system 100 is of known type in construction and operation and will therefore not be described in detail. In brief, the control system 100 comprises various major units, including a mechanical fuel pump 104 with high pressure spool speed governor 114, a pump spill return circuit 106, an electromechanical fuel flow metering unit 108, a main engine digital electronic control unit 110 incorporating an overspeed limiter software module 111, and a shut-off valve 112, which is integrated with the fuel metering unit 108.

Although having full authority over the fuel flow 102 to the aeroengine by means of fuel control signal 118 to the fuel metering unit 108, the fuel control unit 110 does not have any authority over other engine functions, and as can be seen from FIG. 1, variable inlet guide vane (VIGV's) and bleed valves, which are provided in the intermediate and high pressure compressors of the engine, are controlled by a different control unit 120 which is completely separate from the fuel control unit 110 and the rest of the control system 100. Furthermore, the fuel control unit 110 only has full authority over the fuel flow 102 if the rotational speed $N_3$ of the high pressure spool stays below a predetermined limit. If that limit is exceeded—indicating that the high pressure spool is in danger of overspeeding—then the governor unit 114, which is integrated within the same casing as pump unit 104, takes over and reduces fuel flow 102 to the engine in order to prevent such an overspeed, as will be explained in more detail later.

The control system 100 functions as follows. Fuel 122 at low pressure is pumped up to a high pressure in a fuel line 116 by the fuel pump 104, the output of which is throttled by the fuel metering unit 108. The latter item controls the output of the pump 104 in accordance with the fuel control signal 118 produced by the fuel control unit 110. The fuel control unit 110 receives a number of signals $S_A$ and $S_E$ comprising respectively inputs from the aircraft flight station and inputs from various speed, temperature and pressure sensors in the engine. In the present case, signals $S_E$ include the intermediate spool speed $N_2$ and the high pressure spool speed $N_3$. As known in the industry, the fuel flow control unit 110 applies certain predetermined control laws to the signals $S_A$ and $S_E$ for normal control of the engine and thereby produces the fuel control signal 118. However, in addition, and as disclosed and claimed in GB8730187, the overspeed limiter software module 111 comprises a speed limiting control law which defines a variable limit L of $N_2$ as a function of $N_3$, compares the sensed value of $N_2$ with its allowable limit L relative to the sensed value of $N_3$, and, if the sensed value of $N_2$ exceeds that limit, overrides the other control laws embodied in unit 110 and alters the fuel control signal 118 to obtain an appropriate reduction of the fuel flow for reducing $N_2$ back below the limit L. Hence, upon detection of an overspeed of the intermediate pressure spool of the engine, software 111 reduces the fuel flow 102 by means of the metering unit 108, thereby increasing the back pressure in the fuel line 116 and opening or further opening a bypass valve (not shown) controlling fuel flow through the spill return loop 106. The bypass valve may be housed within metering unit 108 or pump unit 104. The excess fuel passed by the bypass valve then passes back to the inlet of the pump 104 for recirculation. For a more detailed disclosure of the implementation of the overspeed limiter 111, the above-mentioned prior application should be consulted.

Finally, the metered fuel 102 is passed to the burners in the combustion chambers of the engine through the shut-off valve unit 112, whose purpose is completely to prevent fuel flow to the engine when the engine is shut down or before it is started, this being achieved by electrical actuation signals 124 from the flight station of the aircraft.

The VIGV and bleed valve control unit 120 also receives input signals $S'_E$ from sensors in the engine and likewise applies appropriate control laws to produce actuation signals 126 for controlling the movement of the VIGV's and the compressor bleed valves in accordance with engine conditions.

Regarding the fuel pump 104, this is driven through a power offtake shaft 128 and gear train (not shown) from the shaft of the high pressure spool of the aeroengine, i.e. that shaft which joins the high pressure turbine to the high pressure compressor, and the output of the pump is directly proportional to the speed at which it is driven. However, the pump and governor unit 104/114 incorporates an emergency spill valve (to be described in connection with FIG. 2) which is under the control of the governor unit 114. The latter item is also driven from the high pressure spool of the engine, through offtake shaft 128 and the associated gear train, at a speed proportional to $N_3$. At the speeds experienced by the high pressure spool during normal operation of the engine, the governor 114 does not operate the emergency spill valve, which therefore allows the pump unit 104 to deliver its full output to the fuel metering unit 108 along fuel line 116. However, in the event of the high pressure spool speed $N_3$ exceeding a certain value indicative of a hazardous overspeed of the spool, the governor 114 acts to open the valve and allow high pressure fuel in line 116 to pass directly back to the low pressure side of the system. This reduces the delivery of the fuel to the engine by an amount sufficient to bring the high pressure spool speed within allowable limits.

Figure 2:
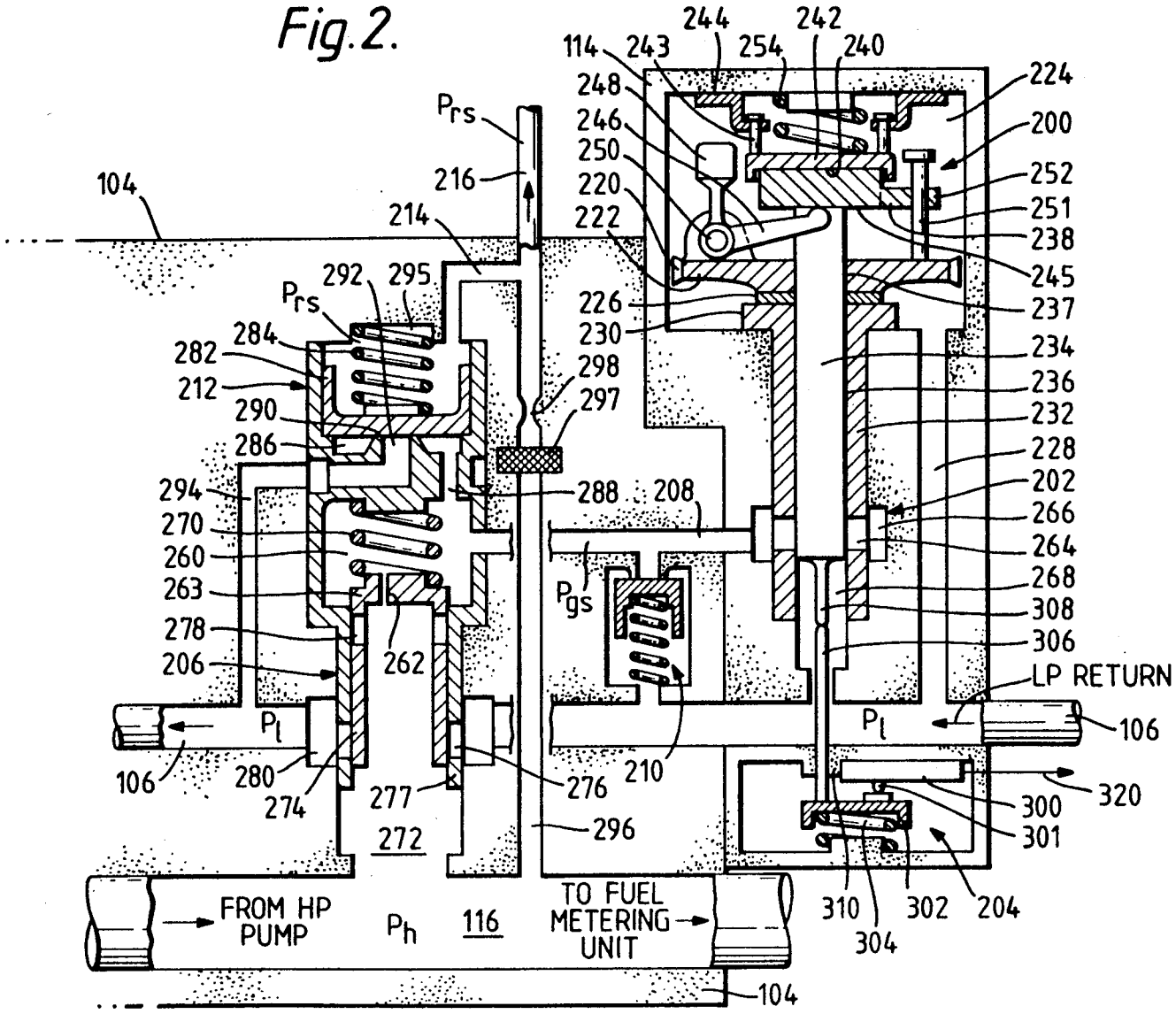
FIG. 2 is simplified composite sectional view of one form of spool speed governor suitable for use in the control system of FIG. 1.

FIG. 2 shows a possible embodiment of the inventive concept. The figure shows the governor unit 114 and an adjoining part of the pump unit 104 containing those components which are most relevant to the present invention.

It will be noted that units 104 and 114 are hydromechanical in operation. Besides a high pressure gear pump (not shown), which pumps fuel at high pressure $P_h$ along pipe 116 to the fuel metering unit 108 (FIG. 1), and a bobweight governor mechanism 200, they also comprise a governor valve 202 actuated directly by the governor mechanism 200, a microswitch arrangement 204 indirectly actuated by the governor mechanism, an emergency spill valve 206, which is linked to and actuated by the governor mechanism 200 through the effect of the governor valve 202 on governor servo pressure $P_{gs}$ in passage 208, a governor servo pressure relief valve 210, and a relay valve 212 which is hydraulically linked via passages 214, 216 to a mechanism associated with the fuel shut off valve 112 (FIG. 1).

A more detailed description of the governor mechanism 200 and its various associated valves is as follows.

A gearwheel (not shown), driven from the offtake shaft 128 (FIG. 1), transmits power to a further gear wheel 220 which forms the outer rim of a bobweight carrier 222. This carrier 222 rotates within a chamber 224 on a fuel-lubricated plain stationary bearing pad 226 of suitable material, the chamber 224 being filled with fuel at low pressure $P_l$ via a passage 228 from the spill passage 106 which carries excess fuel back to the inlet side of the high pressure pump from the fuel metering unit 108 (FIG. 1).

Bearing pad 226 is fixed to the top surface of a flange 230 which forms the upper portion of a long cylindrical collar 232. A stem or rod 234 is journalled within a bore 236 of this collar 232, as extended by a bore 237 in carrier 222, the bores 236 and 237 being plain low-friction bearing surfaces.

At the upper end of rod 234, within chamber 224, is a bearing pad or cap 238, the upper surface 240 of which comprises a bearing surface which is in contact with a complementary bearing surface on the underside of a spring carrier 242. The spring carrier 242 is provided with retaining pins 243 which slideably engage holes in mounting flanges 244 fixed to the outer casing of unit 114. Hence, the spring carrier 242 is restrained against rotational movement, but can slide up and down as required.

The underside of bearing cap 238 comprises a further bearing surface 245 for the lever arms 246 of two bobweights 248, the latter items being pivoted at 250 on their carrier 222. In this area the drawing is a composite section in that at the position where one of the bobweights 248 should be shown there is shown instead one of a pair of drive pins 251 which extend upwardly from the bobweight carrier 222 to slideably engage projections 252 on the bearing cap 238. The drive pins 251 ensure that the bearing cap 238 and the attached rod 234 rotate exactly in unison with the bobweight carrier 222 and its bobweights 248.

The bobweight carrier 222 is driven at a speed which is a direct ratio of the high pressure spool speed $N_3$ and this causes the bobweights 248 to centrifuge outwards. Bobweight movement outward is converted into axially upward displacement of rod 234 by the cam action of the lever arms 246 on the underside 245 of bearing cap 238. This axial displacement is resisted by the action of a bias spring 254 which is compressed between the spring carrier 242 and the casing of unit 114. Since the rod 234 thus slides up and down within bores 236 and 237 whilst rotating, it is therefore necessary that the pins 243 and 251 be sufficiently long to accommodate this.

Turning now to the governor's hydraulic servomechanism, it should be noted that when the governor is not exerting control over spool speed, the governor servopressure $P_{gs}$ in passage 208 and in the space 260 above the emergency spill valve 206 is maintained at a substantially constant value by means of a small bleed of high pressure fuel through a bleed hole 262 in the spool 263 of spill valve 206 and by means of the servopressure relief valve 210, which vents excess pressure from passage 208 to the low pressure fuel in passage 106. Under normal conditions the governor valve is closed, i.e. the lower end of the rod 234 effectively blocks off some ports 264 in the lower end of the collar 232 which communicate between the collar's bore 236 and an annular gallery 266 connected to passage 208. However, if a failure occurs elsewhere in the fuel control system, such that the spool speed $N_3$ reaches an undesirably high predetermined value, the displacement of the rod 234 becomes a correspondingly high value and the holes 264 become partially uncovered, thus allowing governor servo fuel from passage 208 to vent to the lower pressure $P_l$ in passage 106 via space 268 under rod 234. With the consequent lowering of pressure $P_{gs}$ in space 260 above emergency spill valve 206, the force exerted by a compression spring 270 on the top of the valve spool 263 becomes insufficient to prevent the spool 263 from lifting due to the high pressure $P_h$ in the space 272 under the spool. As the spool 263 lifts, the lower part of its skirt 274 uncovers ports 276 in a valve liner 277. The ports 276 communicate with an annular gallery 280 formed in low pressure fuel line 106, thereby allowing fuel to spill directly from the high pressure side of the system in passage 116 to the low pressure side in passage 106. In this way the fuel flow to the engine is reduced and the speed $N_3$ of the high pressure spool of the engine also begins to reduce. Under most circumstances, controlling the speed of the high pressure spool of the engine will also control the speeds of the other two spools.

As speed $N_3$ reduces, so the bobweights centrifuge outwardly to a lesser extent, the rod 234 is biassed downwards under the action of spring 254, the exposed area of ports 264 in governor valve 202 is reduced, pressure $P_{gs}$ is raised to a higher value, and the emergency spill valve 206 begins to close again, reducing spillage of high pressure fuel to the low pressure passage 106. In fact, the emergency spill valve 206 settles to a safe predetermined spill flow level at which the pilot in the flight station can either shut the engine down if necessary or let it continue running, depending on the type of control failure which has occurred. Shut-down is achieved by actuation of the shut-off valve 112 (FIG. 1).

It will be noticed from FIG. 2 that the skirt 274 of spool 263 in emergency spill valve 206 is provided with ports 278 near its upper end. When spool 263 lifts to spill high pressure fuel through ports 276, high pressure fuel also enters chamber 260 above the spool through the ports 278, though the rise in pressure within chamber 260 is not great due to the exposure of the chamber 260 to the low pressure side of the system through passage 208 and the governor valve 202. However, the rise in pressure is just large enough to prevent the valve 206 opening by a large amount too suddenly and thereby causing valve bounce or even shockwaves in the hydraulic part of the system, which would disturb the flow of the fuel and could cause damage to components.

As mentioned above, rapid shut-down of the engine in flight, or during ground running, due to an emergency condition, is achieved by pilot actuation of the shut-off valve 112 (FIG. 1). The relay valve 212 assists in reducing high back pressures in the fuel control system occasioned by such a rapid shut-down. The high back pressures are due to the fact that the rotational inertia of the engine causes the high pressure spool of the engine to keep driving the high pressure fuel pump even after fuel delivery to the engine has been stopped.

Relay valve 212 has a spool 282 which remains seated as shown whilst the engine is receiving fuel and also during any period in which governing of $N_3$ is occurring by the process described above, the spool 282 being biased against its seat by compression spring 284. The underside of spool 282 experiences the governor servo pressure $P_{gs}$ by means of gallery 286 which is joined to chamber 260 by passage 288. Disposed in a central circular portion 290 of the valve seat is a port 292 which is connected to the spill return passage 106 through passage 294. When the shut-off valve 112 (FIG. 1) is actuated by the pilot, it is arranged that its closure causes the relay servo pressure $P_{rs}$ in passages 216 and 214, and in chamber 295 behind spool 282 to drop fairly rapidly, this pressure $P_{rs}$ normally being maintained at a high level due to a connection with the high pressure fuel in passage 116 through passage 296, filter 297 and restrictor 298. The lowering of pressure in chamber 295 allows the governor servo pressure $P_{gs}$ in gallery 286 to overcome spring 284 and the spool 282 lifts off its seat, allowing venting of chamber 260 to the low pressure side of the system through passages 288 and 294. The consequent reduction of pressure in chamber 260 in turn allows the spool 263 of the emergency spill valve 206 to lift and expose ports 276, thereby allowing high pressure fuel from chamber 272 and passage 116 to spill directly into passage 106 as previously described in connection with operation of the governor mechanism. In this way, it is arranged that closure of the shut-off valve 112 whilst the engine is running does not generate excessive back-pressures in the fuel control system.

Turning now to the important aspect of ensuring that the governor mechanism 200 does not suffer from a so-called "dormant failure", FIG. 2 shows that the mechanism 200 is provided with a microswitch arrangement 204. This consists of the microswitch 300 itself with switch button 301, a microswitch actuator plate 302, a compression spring 304 held between plate 302 and the casing of unit 114 to urge plate 302 toward the switch button 301, and a microswitch actuator rod 306 carried from the plate 302 for transmitting the motion of the governor rod 234 to the actuator plate 302.

As can be seen in FIG. 2, the lower end of governor rod 234 has a thinner downward projection 308, the upper end of the actuator rod 306 being urged into contact with the lower end of projection 308 by means of compression spring 304. The rod 306 is steadied against deflection by a boss 310 in which it is slideable, the boss 310 forming part of an internal partition of unit 114 which also supports the microswitch 300.

It will be apparent from the above that whenever the governor rod 234 moves upwards under the action of the bobweights 248, the actuator rod 306 and plate 302 will follow it under the action of spring 304. To expose ports 264 in governor valve 202, and thereby reduce fuel flow to the engine, requires a predetermined high value of spool speed $N_3$, indicative of an overspeed, in order to produce a correspondingly large upward displacement of the governor rod 234, this large displacement being of course larger than any displacement achieved during normal operation of the engine. However, it is arranged that the movement of actuator plate 302 needed to actuate the microswitch 300 requires a lesser displacement of governor rod 234, this lesser displacement being within the range of displacements achieved during normal operation and being less than the above-mentioned large displacement by a predetermined amount. For example, a suitable lesser value of displacement to actuate the microswitch would correspond to, say, 90% of the normal maximum spool speed $N_3$ achieved during takeoff, whereas a suitable large value of displacement to open the governor valve 202 would correspond to, say, 110% of the normal maximum spool speed. Hence, whenever the 90% speed value is attained, the microswitch 300 is actuated to close a circuit through electrical lead 320 which is connected to the fuel control unit 110 (FIG. 1). This is used to check correct functioning of the unit 114, as follows.

The electrical lead 320 includes a wire which carries a low tension voltage supply to the microswitch from the fuel control unit 110. When the circuit through the microswitch 300 is completed, the fuel control unit 110 receives a return signal through another wire in the lead 320, which is used in a known type of trigger and gate circuit to generate a logical one signal for input as a data bit to the unit's data processing computer. Note that although in the present embodiment a data bit is generated by closure of the microswitch to complete a circuit, it is easily within the scope of the average specialist to devise an arrangement in which a data bit is generated by breaking a circuit, and the invention includes such an arrangement. This computer also receives signals $S_E$ from sensors on the gas turbine engine as previously explained, one of these signals being the high pressure spool speed signal $N_3$. The computer is programmed such that if it does not receive the data bit, indicating closure of the microswitch, at substantially the same time as it receives the digitised sensor signal indicating that $N_3$ has attained a value of 90% of its normal maximum value, then incorrect operation of the governor is established and a malfunction is flagged to a warning visual display in the flight station by means of an output 322 to the usual aircraft data bus 324. An output 323 is also made to a maintenance message store 326 in the unit 110 which can be read out by maintenance personnel through an LED or LCD display 328 mounted on the unit's casing.

Of course, if the 90% $N_3$ signal and the microswitch signal are received substantially simultaneously, the computer does not produce a malfunction flag, since correct operation of the governor has been established.

The person skilled in the art will readily appreciate how to program the data processing computer of control unit 110 in order to achieve the above-described check on the functioning of governor 200. Such a person will also realize that the microswitch arrangement associated with the governor 200 and control unit 110 need not be arranged to operate at a value of 90% of normal maximum spool speed $N_3$—it could be arranged to operate at any point within the normal operational speed range of the spool. Furthermore, for added reliability, it is preferred that the microswitch 204, and its electrical lead 320, be duplicated and the control unit 110 with its software be adapted so that failure of one microswitch, though generating a maintenance attention signal for storage in store 326, does not generate a signal 322 indicating failure of the governor 200.

Although the specific embodiment of the invention described in relation to the drawings was of an overspeed governor, it will be realized that the invention could also be applied to implement a self-checking ability for governors which exercise control over a wide speed range, rather than merely exercising an overspeed limiting function for speeds in excess of a certain value.

Whereas the above description has focussed on the use of electrical microswitches to provide a data (switch open or closed) signal for time comparison with the digitized sensor signal indicating that $N_3$ has attained a certain predetermined value, the invention is not limited to such switches, and such a data signal could well be provided by other forms of switch. Various possibilities will suggest themselves to the average specialist: for example an optical switch dependent on the sensing or interruption of light incident on a photodiode, or a proximity switch of the capacitance type.

I claim:

1. A self-checking governor arrangement for controlling the rotational speed of a spool in a gas turbine engine, comprising:

a displaceable member;

a displacing device which effects displacement of the displaceable member by an amount which varies directly with said rotational spool speed;

a biasing device which contacts said displaceable member to act against said displacement of the displaceable member;

valve means for controlling fuel flow to the engine, the valve means being actuatable by the displaceable member to reduce fuel flow to the engine in dependence upon said displacement of said displaceable member;

switch means actuatable by said displacement of the displaceable member, the biasing device abutting said switch means over at least a portion of said displacement such that said switch means generates a switch signal indicative of when said displaceable member is displaced by a predetermined amount corresponding to a predetermined spool speed within a predetermined normal range of spool speeds experienced by said spool during normal operation of said engine;

sensor means for generating a spool speed signal whose valve varies with said rotational speed of said spool; and data processing means connected to receive said switch signal and said spool speed signal, said data processing means being adapted to determine whether receipt of the switch signal substantially coincides with receipt of a value of the spool speed signal corresponding to said predetermined spool speed and to output a governor status signal dependent upon the result of said determination.

2. A self-checking governor arrangement according to claim 1 wherein said displacing device comprises a rotary mechanism driven from said spool for displacing the displaceable member against said biasing device by said amount which varies directly with said rotational spool speed.

3. A self-checking governor arrangement according to claim 1, in which the valve means is arranged such that it is actuated by the displaceable member to reduce fuel flow only when displacement of the displaceable member attains a large predetermined amount indicative of a spool speed beyond said predetermined normal range of spool speeds.

4. A self-checking governor arrangement according to claim 1 in which the switch means comprises at least one microswitch.

5. A self-checking governor arrangement according to claim 1 in which the data processing means is adapted to output a signal indicative of satisfactory operation of the governor arrangement whenever said receipt of said switch signal occurs substantially simultaneously with said receipt of said value of said spool speed signal.

6. A self-checking governor arrangement according to claim 1 in which the data processing means-is adapted to output a signal indicative of unsatisfactory operation of the governor arrangement whenever receipt of said switch signal does not occur substantially simultaneously with said receipt of said value of said spool speed signal.

7. A self-checking governor arrangement according to claim 1 in which the data processing means comprises a digital electronic controller which is part of a main fuel control system in the engine.

8. A self-checking governor arrangement according to claim 1 in which the displaceable member is part of a bobweight governor mechanism.

9. A gas turbine engine incorporating a self-checking governor arrangement according to claim 1.

10. A gas turbine engine comprising at least a high pressure spool and a low pressure spool and incorporating a self-checking governor arrangement according to claim 1, said governor arrangement controlling the high pressure spool of the engine.

11. A self-checking governor arrangement according to claim 1 further comprising a governor housing in relation to which said displacement of the displaceable member occurs;

wherein said biasing device comprises at least one compression means for forcing said displacement member away from a wall of said governor housing.

12. A self-checking governor arrangement according to claim 11 wherein said compression means comprises a spring in compression.

13. A self-checking governor arrangement according to claim 1 wherein said displaceable member comprises a rod portion and an arm portion, said rod portion contacting said arm portion and acting through said arm portion to effect said displacement of the displaceable member.

14. A self-checking governor arrangement according to claim 1 wherein said switch means comprises two microswitches, the switch signal generated by one of said microswitches being compared to the switch signal of the other of said microswitches to determine the operability of said microswitches.

* * * * *